US007005634B2

(12) United States Patent
Shiokawa et al.

(10) Patent No.: US 7,005,634 B2
(45) Date of Patent: Feb. 28, 2006

(54) IONIZATION APPARATUS

(75) Inventors: Yoshiro Shiokawa, Hachioji (JP); Megumi Nakamura, Fuchu (JP); Tohru Sasaki, Fuchu (JP); Toshihiro Fujii, Hamura (JP)

(73) Assignee: Anelva Corporation, Tokyo (JP)

( * ) Notice: Subject to any disclaimer, the term of this patent is extended or adjusted under 35 U.S.C. 154(b) by 191 days.

(21) Appl. No.: 10/102,954

(22) Filed: Mar. 22, 2002

(65) Prior Publication Data

US 2002/0139930 A1 Oct. 3, 2002

(30) Foreign Application Priority Data

Mar. 29, 2001 (JP) ..... 2001-096832

(51) Int. Cl.
*H01J 49/00* (2006.01)

(52) U.S. Cl. ..... 250/288; 250/289; 250/423 F; 250/423 R

(58) Field of Classification Search ..... 250/423 R, 250/425, 426, 288, 289, 423 F
See application file for complete search history.

(56) References Cited

U.S. PATENT DOCUMENTS

| | | | | |
|---|---|---|---|---|
| 3,233,137 A | * | 2/1966 | Anderson et al. | 315/176 |
| 4,178,507 A | * | 12/1979 | Brunnee et al. | 250/282 |
| 4,496,843 A | * | 1/1985 | Kirita et al. | 250/426 |
| 4,534,921 A | * | 8/1985 | Fierkens et al. | 264/39 |
| 4,786,352 A | * | 11/1988 | Benzing | 156/345.48 |
| 4,853,539 A | * | 8/1989 | Hall et al. | 250/288 |
| 5,101,110 A | * | 3/1992 | Matsudo et al. | 250/427 |
| 5,252,892 A | * | 10/1993 | Koshiishi et al. | 315/111.81 |
| 5,315,121 A | * | 5/1994 | Kluge et al. | 250/423 R |
| 6,146,492 A | * | 11/2000 | Cho et al. | 156/345.24 |
| 6,479,814 B1 | * | 11/2002 | Shiokawa et al. | 250/283 |
| 6,504,149 B1 | * | 1/2003 | Guevremont et al. | 250/286 |
| 6,507,020 B1 | * | 1/2003 | Shiokawa et al. | 250/288 |
| 6,635,868 B1 | * | 10/2003 | Shiokawa et al. | 250/288 |

FOREIGN PATENT DOCUMENTS

| | | |
|---|---|---|
| JP | A 1-255146 | 10/1989 |
| JP | A 6-11485 | 1/1994 |
| JP | A 2002-170518 | 6/2002 |

* cited by examiner

*Primary Examiner*—Nikita Wells
*Assistant Examiner*—Anthony Quash
(74) *Attorney, Agent, or Firm*—Oliff & Berridge, PLC

(57) ABSTRACT

An ionization apparatus according to the present invention has a mechanism for causing metal ions emitted from an ion emitter to attach to an introduced target gas so as to generate ions of the sample gas and emits the ions of the sample gas to a mass spectrometer. The mass spectrometer has a zone in which one or both of an electric field and magnetic field are formed. As the electrode for causing the generation of cleaning plasma in the ionization zone generating the ions of the sample gas, the ion emitter is used. The ion emitter causes the generation of plasma in connection with a hollow vessel and removes deposits on components facing the ionization zone by the plasma. The plasma cleaning process is performed consecutively at a suitable timing after the ionization process. Due to the above configuration, deteriorated performance in ionization can be restored in a short time, a memory effect can be prevented, and accurate mass spectrometry becomes possible. The ionization apparatus of the present invention is suitable for a mass spectrometry apparatus.

16 Claims, 9 Drawing Sheets

IONIZATION APPARATUS

BACKGROUND OF THE INVENTION

1. Field of the Invention

The present invention relates to an ionization apparatus, more particularly relates to an ionization apparatus using ion attachment ionization and suitable for mass spectrometry of a target gas including a gaseous state organic substance, chemically active substance, or highly adsorptive substance.

2. Description of the Related Art

As for the mass spectrometry of various types of gases there are conventional mass spectrometry methods of ionizing a target gas to make ions, then separating and analyzing the ions by mass using one or both of an electric field and a magnetic field. There are various methods for ionization of the target gas. Among these, the ion attachment ionization method has the feature of a lower excess energy at the time of ionization than other methods of ionization. In this ion attachment ionization method, the target gas is defined as a gas being a target substance for analysis, while a sample gas is defined as a gas made by attaching metal ions to the target gas, which is measured by a mass spectrometer. The ion attachment ionization method enables measurement even when the target gas is comprised of gaseous molecules including weak bonds among atoms. The ion attachment ionization method has the advantage of a broader range of types of gas which can be measured than electron impact ionization, chemical ionization, or other methods.

The ion attachment ionization method enables for example alkali metal ions or other metal ions to be directly attached to gaseous molecules. The procedure and apparatus for this ionization method is for example disclosed in Japanese Unexamined patent Publication (Kokai) No. 6-11485 and Japanese Examined patent Publication (Kokoku) No. 7-48371.

Next, a representative conventional ionization apparatus for ion attachment mass spectrometry will be explained with reference to FIG. 12 and FIG. 13. FIG. 12 is a perspective view of an ionization apparatus showing part of the internal structure, while FIG. 13 is a schematic longitudinal sectional view of the same.

A conventional ionization apparatus used for an ion attachment mass spectrometry apparatus is comprised for example of a closed end cylindrically shaped hollow vessel 101 connected to a mass spectrometry apparatus 103 through a screen 102 having an aperture 102*a*. An ion emission mechanism 105 is arranged in the space inside the hollow vessel 101, that is, the ionization zone 104. The ion emission mechanism 105 is comprised of a lead wire 106 made of a refractory material such as tungsten and an ion emitter 107 comprised of for example alumina silicate doped with an alkali metal salt and attached to the lead wire 106. The lead wire 106 is led to the outside from an attachment part 108 provided at part of the hollow vessel 101. A gas introduction mechanism 109 is provided at the bottom 101*a* at the left end of the hollow vessel 101 in the figure. The gas introduction mechanism 109 introduces the target gas and one more gas which acts as a third-body in a mixed state to the ionization zone 104. The third-body gas is an inert gas such as nitrogen. It strips the excess energy occurring when metal ions attach to the gaseous molecules comprising the target gas (an analysis target substance without the metal ions) to make the ions of the sample gas and prevents the ions from again separating into the target substance and the metal ions.

The ionization zone 104 in the hollow vessel 101 is supplied with the third-body gas and target gas from the gas introduction mechanism 109 and evacuated by a vacuum pump (not shown) provided at the mass spectrometry apparatus 103 to be held in a pressure state of about 100 Pa. In that state, a current is run through the lead wire 106. Using the resistance heat, the ion emitter 107 is heated to about 600° C. When this happens, the substantially spherical ion emitter 107 produces metal ions on its surface. If a voltage of about 10V is applied to the lead wire 106 to give it a positive potential, the screen 102 is made the ground potential, and the inside of the mass spectrometry apparatus 103 is held at a negative potential, a potential gradient can be formed in the ionization zone 104. Due to this potential gradient, the metal ions are emitted from the ion emitter 107 and transported to the mass spectrometry apparatus 103 side. In the transport process at the ionization zone 104, the metal ions impact the target substance for analysis and gently attach to the charged locations thereof to thereby produce ions of the sample gas. The ions of the sample gas continue to be transported to the mass spectrometry apparatus 103 side as they are, pass through the aperture 102*a* provided at the screen 102, and are thereby emitted outside of the ionization apparatus.

According to the above ionization apparatus, when the target gas includes gaseous molecules comprised of an organic substance including weak bonds between atoms or a chemically active substance, if contacting the ion emitter 107, the target gas is broken down by the heat transmitted from the heated ion emitter 107 and polymerization or chemical reactions are caused. Due to these chemical reactions, substances other than the target substance for analysis which are originally not covered by the mass spectrometry are produced. The amount of production of these substances other than the target substance for analysis is extremely small and is substantially negligible in measurement by mass spectrometry. The substances other than the target substance for analysis, however, deposit on the ion emitter and other components facing the ionization zone and build up along with the measurement time (cumulative hours of operation of the apparatus). These substances deposited on the components are called "by-products" below. As a result of the buildup, the problems arise of a drop in the amount of emission of the metal ions, a detrimental effect on the transport of ions required for measurement, etc. and therefore a drop in the detection sensitivity.

An ion emitter 107 impaired in function of emission of metal ions sometimes can be restored in function by holding it in a vacuum or exposing it to oxygen in a heated state. This restoration is not always effective depending on the type of the target gas. Note that when the target gas includes an organic substance, this problem can be solved by the invention disclosed in Japanese Patent Application No. 2000-369876 of the same assignee as the present application.

For restoration of components facing the ionization zone 104, it is necessary to either stop the mass spectrometry apparatus or ionization apparatus and return the inside once to the atmospheric pressure and then clean it or remove the dirty components from the apparatus and clean them. If the mass spectrometry apparatus or ionization apparatus is stopped once to return the inside of the apparatus to atmospheric pressure, a long standby time will be required before it can be returned it to a state enabling measurement once again. Further, when the target gas is a silane ($SiH_4$) based gas, solid substances ($SiO_2$, etc.) will precipitate on the inside wall of the ionization apparatus due to the exposure to the atmosphere. These solid substances will enter into the mass spectrometry apparatus with its complicated and precise structure and make accurate measurement impossible.

Further, even when a substance other than the above organic substance or chemically active substance is used as the target gas, the gaseous molecules are adsorbed on to the wall inside the ionization apparatus. This state sometimes is held for a certain period of time and is a cause of a "memory effect". In measurement by mass spectrometry without sufficient intervals provided between measurements, the target gas used in the previous measurement will remain in the ionization apparatus, though in a small amount, resulting in the problem of an inability of accurate measurement by mass spectrometry. This problem appears most remarkably when the target gas includes a substance highly adsorptive to solid substances etc.

SUMMARY OF THE INVENTION

An object of the present invention, in consideration of the above problems, is to provide an ionization apparatus which can restore deteriorated performance of the ionization apparatus in a short time and can restore deteriorated performance without stopping the mass spectrometry apparatus or ionization apparatus. Another object of the present invention is to provide an ionization apparatus suitable for a mass spectrometry apparatus which can prevent a memory effect and enable accurate mass spectrometry.

An ionization apparatus according to the present invention is comprised as follows to achieve the above objects.

The ionization apparatus according to the present invention has as its underlying configuration means for causing metal ions emitted from an ion emitter to attach to an introduced target gas so as to produce ions of the sample gas and emitting the ions of the sample gas to a mass spectrometer having a zone in which one or both of an electric field and magnetic field are formed. The principle of ion attachment ionization is used for the ionization. The ionization apparatus is normally used only for the ionization process. On the other hand, when the ionization process continues, by-products deposit on the surface of the ion emitter or structures facing the ionization zone. In particular, there is remarkable occurrence of deposits when the target gas includes gaseous state organic substances, chemically active substances, or highly adsorptive substances. Therefore, the ionization apparatus is configured to enable initiation of a cleaning process using plasma. That is, it is provided with an electrode for generating cleaning plasma in the ionization zone producing the ions of the sample gas. Due to this, the deposits on the components facing the ionization zone are removed by plasma. Normally, the plasma cleaning process is performed consecutively at a suitable timing after the ionization process.

As the electrode for causing discharge in the plasma cleaning process, any of the components arranged inside the ionization zone can be used. Particularly preferably, the ion emitter or the ion focusing electrode used in the ionization process is used as the electrode. Further, it is possible to provide an electrode especially for discharge inside the ionization zone.

When causing the generation of cleaning plasma in the space for ionization inside the hollow vessel of the ionization apparatus (ionization zone), the third-body gas used in the ionization process is used as the discharge gas. Further, substantially the same pressure condition as the pressure condition at the ionization process (typically 100 Pa) is used. Therefore, the conditions set in the plasma cleaning process can be the same ones used in the process of ionization by ion attachment ionization.

An ionization apparatus according to another aspect of the present invention has the above-mentioned underlying configuration plus a hollow vessel formed inside it with an ionization zone for producing ions of a sample gas and having a wall at the ionization zone side made by an electroconductive member, an ion emission mechanism for emitting metal ions, a discharge gas introduction mechanism for introducing a discharge gas into the ionization zone, and an evacuation mechanism for discharging the discharge gas which had been introduced into the ionization zone outside of the hollow vessel. In the above configuration, the ionization zone is held at a predetermined pressure by introducing discharge gas into the ionization zone by the discharge gas introduction mechanism while evacuating the zone by the evacuation mechanism, plasma is generated in the ionization zone using one of the ion emission mechanism and the hollow vessel as a cathode and the other as an anode, and thereby a deposit on the component facing the ionization zone and used as the cathode is removed.

In the above, the pressure is preferably the ordinary pressure of 100 Pa in the ionization process. Further, it is possible to cause the discharge for plasma cleaning by utilizing the structural parts provided together with the ionization apparatus. Therefore, a power source, a mechanism for switching the operation of the power source, and a control device are provided outside of the hollow vessel of the ionization apparatus. In particular, the pair of electrodes, that is, the anode and cathode, for causing discharge are suitably selected in accordance with the purpose of the cleaned location.

In the above configuration, when removing the deposit on the ion emission mechanism facing the ionization zone, the ion emission mechanism is preferably made the cathode, while when removing the deposit on the inside wall of the hollow vessel facing the ionization zone, the inside wall of the hollow vessel is preferably made the cathode.

In the above configuration, the process of causing the generation of plasma in the ionization zone to remove the deposit on components facing the ionization zone is performed consecutively after the process of causing metal ions to attach to the target gas to generate ions of the sample gas and emitting the ions of the sample gas to the mass spectrometer.

In the above configuration, further, when the target gas is a gaseous state organic substance, after the ionization of the target gas, oxygen is introduced into the ionization zone and plasma is caused to be generated in the ionization zone while maintaining a predetermined pressure. Further, when the target gas is a gaseous state metal compound or a compound including a semiconductor, after the target gas is ionized, a halogen-based gas is introduced into the ionization zone and plasma is caused to be generated in the ionization zone while maintaining a predetermined pressure.

According to the above configuration, when by-products deposit on the ion emitter emitting the metal ions or other components and the amount of production or amount of detection of the ions of the sample gas falls, that is, when the detection sensitivity of the mass spectrometry apparatus falls, plasma is made to be generated by the above mechanism inside the ionization zone to remove the deposits on the components facing the ionization zone. Due to this, it is possible to restore the performance of the ionization apparatus.

In the above, as the mechanism for causing the generation of plasma, for example, a cathode and anode, that is, electrode structural members, in the case of capacitive discharge, a coil, that is, a spiral-shaped electroconductive member, in the case of inductive discharge, an electromagnetic wave generating member in the case of discharge by electromagnetic wave heating, etc. are suitable. These are selectively used in accordance with the inherent structure or objective of the apparatus.

The plasma generation mechanism may be newly provided for just that purpose, but when the ionization apparatus is provided inside it with an ion focusing electrode or repeller electrode or when the ionization apparatus is configured to trap ions of a predetermined mass (hereinafter called an "ion trap type"), it is possible to use the end gap electrodes, ring-shaped electrode, or other electrodes contributing to the transport of the metal ions or ions of the sample gas.

Further, the ionization apparatus according to still another aspect of the present invention has the above underlying configuration plus a plasma generation chamber having a plasma generation zone communicated with the ionization zone where ions of the sample gas are produced and provided with a discharge gas introduction mechanism and plasma generation mechanism, a plasma pull-in electrode arranged at the ionization zone, and an evacuation mechanism for evacuating the ionization zone and plasma generation zone. In this configuration, the ionization zone and plasma generation zone are held at a predetermined pressure, the plasma generation zone is made to generate first plasma by the plasma generation mechanism, the first plasma is pulled into the ionization zone by the plasma pull-in electrode to cause the generation of second plasma, and thereby a deposit on a component facing the ionization zone is removed.

The above plasma generation mechanism uses a rod-shaped electrode or spiral-shaped electrode. Further, the pull-in electrode serves also as an electrode contributing to transport of the ions when emitting the ions of the sample gas to the mass spectrometer.

The above ionization apparatus is suitable when for example there is an easily breakable component in the ionization zone, when there are many components of many types arranged there and provision of a plasma generating means nearby would not be possible, etc. This ionization apparatus provides a plasma generation zone so as to adjoin the ionization zone, causes the generation of first plasma in the plasma generation zone, and pulls in the electrons in the first plasma from the plasma generation zone to the ionization zone by the plasma pull-in electrode given a higher potential than the first plasma to cause the generation of the second plasma.

The plasma pull-in electrode may be newly provided just for that purpose, but it is suitable to use the ion focusing electrode or repeller electrode provided inside the ionization apparatus or, when the ionization apparatus is an ion trap type, the end gap electrodes, ring-shaped electrode, or other electrodes. The plasma pull-in electrode functions as an ion focusing electrode or repeller electrode when the ionization apparatus emits the ions of the sample gas to the mass spectrometry apparatus and as an end gap electrode or ring-shaped electrode when the ionization apparatus is an ion trap type and is made a pull-in electrode so that the potential becomes higher than the first plasma when removing a deposit on a component facing the ionization zone.

As another suitable means, the plasma pull-in electrode can be configured to serve also as the ion emission mechanism for emitting the metal ions. At this time as well, the ion emission mechanism is given a higher potential than the first plasma.

By making use of components used in the ionization process for the plasma generation mechanism and the plasma pull-in electrode, it is possible to reduce the number of components and reduce the space taken up by the apparatus.

In the ionization apparatus, the ionization process and the process of cleaning away the by-products using plasma are preferably performed consecutively. The plasma should be generated in the ionization zone right before measurement by mass spectrometry of the sample gas or right after that measurement. By this, even when measuring a qualitatively or quantitatively different target gas in the preceding or succeeding mass spectrometry measurement, the gas remaining in the ionization apparatus or the deposits on the components are removed and the interval until the next accurate measurement by mass spectrometry becomes shorter. Further, it is possible to completely restore the function of the apparatus before deterioration of the function progresses.

The gas introduced into the ionization zone at the time of generation of plasma is made oxygen. This is because by-products deposited due to ionization can be easily removed by oxygen when for example the target gas includes a gaseous state organic substance. Further, when removing deposits on the ion emitter by plasma, the surface of the ion emitter is also slightly etched. The ion emitter does not emit a sufficient amount of metal ions in a state not oxidized. Therefore, using oxygen as the gas for causing generation of plasma in the ionization zone is suitable for removal of deposits comprised of organic substances and can cause oxidation of the surface of the ion emitter while removing the deposits when removing them on the ion emitter.

Further, when the target gas is a metal compound or a compound including a semiconductor, it is preferable to use a halogen-based gas for the discharge gas introduced into the ionization zone. This halogen-based gas is for example a halogen containing gas such as $NF_3$ or $SF_6$. If generating plasma in such an atmosphere, halogen-based free radicals are produced. These free radicals have a high reactivity with the by-products produced when a target gas is comprised of tungsten (W) or aluminum (Al) or another metal for forming interconnections of an electronic component or a compound containing silicon (Si) or another semiconductor is ionized and are particularly effective when removing by-products deposited on the components in the ionization apparatus when containing these metal compounds or compounds including semiconductors.

According to the present invention, when the amount of production or amount of detection of the ions of the sample gas drops, that is, when the detection sensitivity of the mass spectrometry apparatus falls, it is possible to realize a plasma cleaning process using the hardware configuration provided for the ionization process of the ionization apparatus, so it is possible to restore the performance of the apparatus without opening up the inside of the ionization apparatus to the atmosphere. In particular, this is optimal for ionization in mass spectrometry of a target gas including gaseous state organic substances, chemically active substance, or highly absorptive substances and enables restoration of the deteriorated performance of an ionization apparatus in a short time. In addition, it is possible to prevent a memory effect and enable accurate mass spectrometry.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

Preferred embodiments of the present invention will be explained next with reference to the drawings. The configurations, shapes, and relative arrangements explained in the embodiments are only described in brief to an extent enabling understanding of the present invention. Further, the numerical values and compositions (materials) of the components are only illustrations. Therefore, the present invention is not limited to the embodiments explained below and can be changed in various manners so long as not outside of the scope of the technical concept set forth in the claims.

Figure 1:
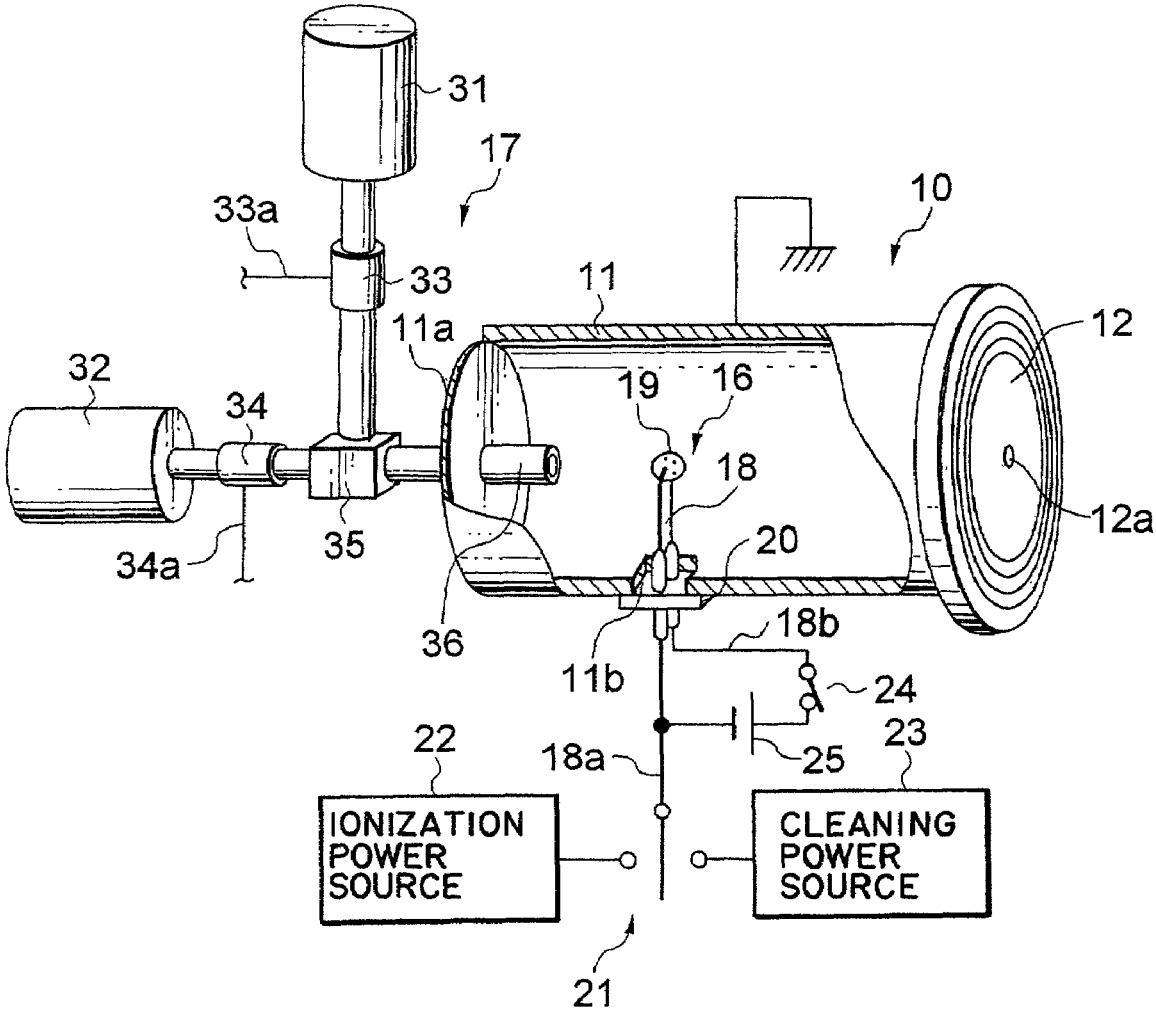
FIG. 1 is a perspective view of a first embodiment of an ionization apparatus according to the present invention partially cut away to show the principal structure inside.
Figure 2:
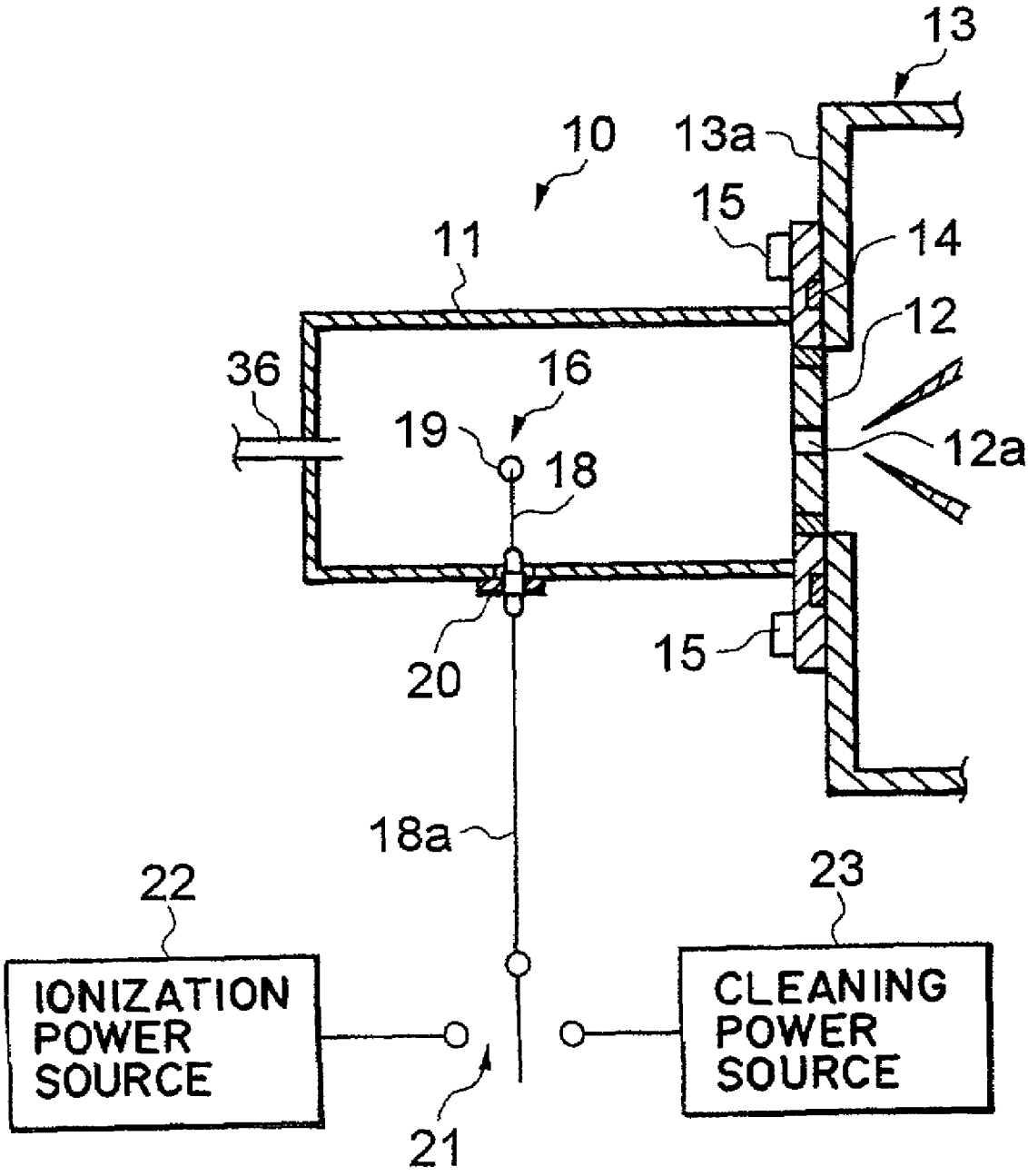
FIG. 2 is a longitudinal sectional view of the ion apparatus shown in FIG. 1.

A first embodiment of the present invention will be explained with reference to FIG. 1 and FIG. 2. FIG. 1 is a perspective view of an ionization apparatus partially cut away to show the principal structure inside, while FIG. 2 is a longitudinal sectional view of the same. In this embodiment, the example is shown where the ion emitter for emitting metal ions for ionization is also used as an electrode at the time of cleaning.

As shown in the figures, the ionization apparatus 10 has a closed-end cylindrically shaped hollow vessel 11 formed by a metal material. In this embodiment, the hollow vessel 11 is grounded and held at the ground potential (zero potential). At the left end surface of the hollow vessel 11 in the figure is formed the bottom 11*a*. At the right end side in the figure is affixed a disk-shaped screen 12 having an aperture 12*a* at its center. As shown in FIG. 2, the hollow vessel 11 is connected to a mass spectrometry apparatus 13 through the screen 12. Between the screen 12 and the left end surface 13*a* of the mass spectrometry apparatus 13 is interposed a ring-shaped seal member 14. The screen 12 is fixed by screws 15 to the left end surface 13*a*.

The above ionization apparatus 10 is provided with an ion emission mechanism 16 and a gas introduction mechanism 17.

The ion emission mechanism 16 is comprised of a lead wire 18 formed by bending a wire in a U-shape and an ion emitter 19 attached to the same. The lead wire 18 is attached through an insulator 20 at an aperture 11*b* formed in the cylindrical part of the hollow vessel 11. The two ends 18*a* and 18*b* of the lead wire 18 are further led outside of the hollow vessel 11. The ion emitter 19 emits positive metal ions such as $Li^+$. Usually, in the ionization process, the ion emitter 19 functions as a source of emission of metal ions.

Figure 3:
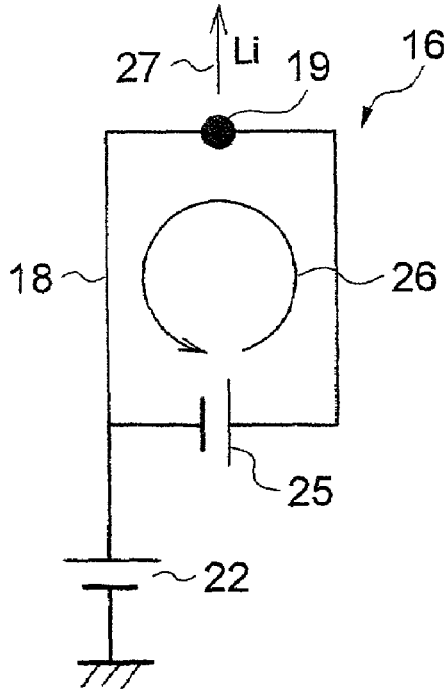
FIG. 3 is an electrical circuit diagram of an ion emission mechanism in an ionization process of the ionization apparatus according to the first embodiment.
Figure 4:
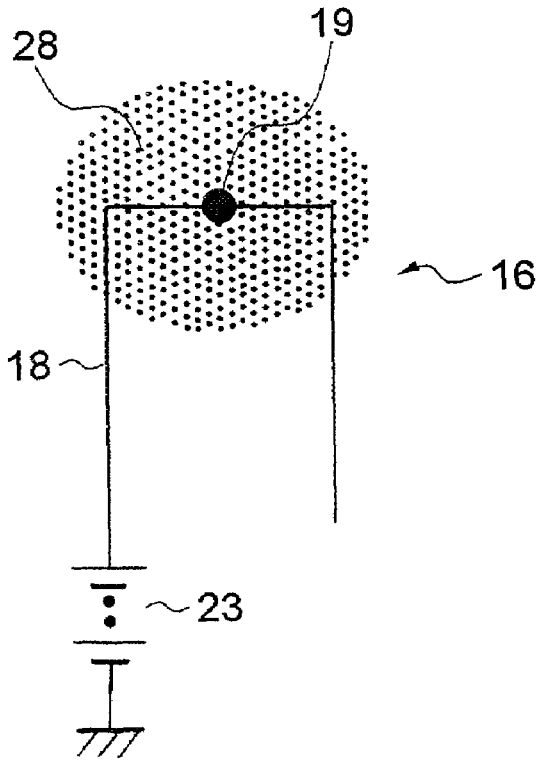
FIG. 4 is an electrical circuit diagram of an ion emission mechanism in a cleaning process of the ionization apparatus according to the first embodiment.

One end 18*a* of the lead wire 18 positioned outside of the hollow vessel 11, in one example, is connected to one of two power sources 22 and 23 through a switch 21. The other outside end 18*b* of the lead wire 18 is connected to a heating power source 25 through a switch 24. In the ionization process (at the time of ionization operation), the switch 24 is turned to the ON position. At that time, the heating power source 25 is connected between the terminals 18*a* and 18*b* of the lead wire 18 and sends a heating use current (for example, about 4A) to the lead wire 18 and ion emitter 19. In the cleaning process (at the time of the cleaning operation), the switch 24 is turned to the OFF position. The ON/OFF operation of the switch is usually performed automatically by a not shown control device. The power source 22 is used for the ionization process, while the power source 23 is used for the cleaning process. One of the power sources 22 and 23 is connected to by the switching operation of the switch 21. The switching operation of the switch 21 is performed automatically by the above control device (not shown). The ionization power source 22 is preferably set to supply a voltage of 10V to the ion emitter 19 and run an emission current of 0.1 $\mu$A. An electrical equivalent circuit of the ion emission mechanism 16 at the time of the ionization operation is shown in FIG. 3. In FIG. 3, 26 shows the heating current flowing through the lead wire 18 due to the heating power source 25, while 27 shows the state where metal ions ($Li^+$) are emitted from the ion emitter 19. The emitter metal ions become the above emission current. Further, the ion emitter 19 is supplied with 10V by the power source 22. On the other hand, the cleaning power source 23 supplies a voltage of preferably 200V to the ion emitter 19 through the lead wire 18 to cause discharge for generating plasma in the ionization zone. In the cleaning process, the switch 24 is turned to the OFF position, so the terminal 18 is open. As a result, the power source 23 supplies the ion emitter 19 with a voltage of 200V. An electrical equivalent circuit of the ion emission mechanism 16 at the time of the cleaning operation is shown in FIG. 4. In FIG. 4, 28 shows the plasma generated around the ion emitter 19. As shown in FIG. 4, the power source 23 supplies the ion emitter 19 with a voltage of 200V. If plasma for cleaning use is generated in this state, a current of several mA flows.

The operations of the switch 21 and the switch 24 are, as explained above, controlled by a control device. They are controlled at suitable timings in accordance with the ionization process or cleaning process.

In the above embodiment, for convenience in explanation, two power sources 22 and 23 for the ionization and the cleaning were provided, but it is of course also possible to provide a single power source. In this case, the power source is controlled in operating state to an ionization setting or a cleaning setting by the control device.

The gas introduction mechanism 17 is provided with a target gas tank 31, a third-body gas tank 32, valves 33 and 34, a mixer 35, and an introduction pipe member 36. The front end of the introduction pipe member 36 is connected to the substantially center part of the bottom 11*a* of the hollow vessel 11. The valves 33 and 34 are operated based on operational control signals given from signal lines 33*a* and 34*a* for controlling operation. The target gas and third-body gas or only the third-body gas are introduced into the ionization zone from the front opening of the introduction pipe member 36 depending on the operating states of the valves 33 and 34. Note that in the figure, the illustration of the control device for giving the operational control signals to the valves 33 and 34 through the signal lines 33*a* and 34*a* is omitted.

Next, the ionization operation (production of ions of sample gas) and the cleaning operation in the ionization apparatus 10 will be explained.

When producing ions of the sample gas in the ionization apparatus 10, the target gas and third-body gas are simultaneously introduced from the gas introduction mechanism 17 to the ionization zone. The ionization zone is evacuated by a vacuum pump provided at the mass spectrometry apparatus 13 through an aperture 12*a* provided at the screen 12. The pressure of the ionization zone at this time is maintained at about 100 Pa. In this state, current is run through the lead wire 18 by the heating power source 25 and the resistance heat is used to heat the ion emitter 19 to about 600° C. Further, a voltage of 10V is supplied to the ion emitter 19 by the ionization power source 22. The ion emitter 19 produces metal ions on its surface.

The ion emitter 19 is supplied with voltage of about 10V by the power source 22 through the lead wire 18 to make it a positive potential. The screen 12 is held at the ground potential and the inside of the mass spectrometry apparatus 13 is held at a negative potential to create a potential gradient in the ionization zone. Due to the potential gradient, metal ions are disassociated (emitted) from the ion emitter 19. These metal ions are passed through the aperture 12*a* of the screen 12 and transported to the mass spectrometry apparatus 13 side. The metal ions impact with the target gas in the process of transport and gently attach to the charged locations of the target substance for analysis. Ions of the sample gas are thereby produced. The ions of the sample gas continue to travel to the mass spectrometry apparatus 13 side in that state due to the electric field and finally pass through the aperture 12*a* provided at the screen 12 to be emitted to the outside of the ionization apparatus 10. The ions of the sample gas exiting the ionization apparatus 10 are separated and analyzed for mass in the mass spectrometry apparatus 13 based on well-known actions.

Next, the cleaning operation in the ionization apparatus 10 will be explained. When performing the above ionization process in the ionization apparatus 10 continuously or intermittently for more than a certain time, by-products deposit and build up on the components inside of the ionization apparatus 10 (surface of ion emitter 16, inside surface of hollow vessel 11, etc.) Therefore, to remove the by-products, plasma is caused to be generated inside the ionization apparatus 10 to clean them away. At the time of the cleaning operation, the introduction of target gas from the gas introduction mechanism 17 is stopped and the introduction of the third-body gas is continued as is. The third-body gas is used as the discharge gas. The pressure state in the ionization zone inside the hollow vessel 11 is substantially the same as in the case of ionization. In this state, the switch 24 is turned to the OFF position and the switch 21 is turned to the cleaning power source 23 side so as to supply voltage of 200V to the ion emitter 19 from the power source 23. At the time of the cleaning operation, the ion emitter 19 (ion emission mechanism 16) is used as an electrode for generation of the plasma. Plasma is generated between the ion emitter 19 used as the electrode and the grounded hollow vessel 11. When a predetermined power is supplied to the ion emitter 19, discharge occurs at the ionization zone and plasma is generated. This plasma removes the by-products deposited on the surface of the ion emitter 19 or the inside surface of the hollow vessel 11.

In case of the cleaning by plasma, it is desirable to make the component with the deposits desired to be removed the lowest potential. Thereby, ion bombardment by the plasma is enhanced on the component. In the case of the first embodiment, for example, by supplying a high minus voltage to the ion emitter 19 itself, it is possible to particularly remove the deposits from the surface of the ion emitter 19. At this time, the cleaning ions concentrate on the surface of the ion emitter 19.

According to the first embodiment, there is provided an ion attachment type ionization apparatus which has a plasma cleaning process for removing inside deposits (by-products) which does not require a special device for generation of plasma, can use the same pressure condition as in the ionization process and use the third-body gas used in the ion attachment (Ar gas etc.) as the discharge gas for plasma generation, and can use the ion emission mechanism itself as an electrode. Therefore, it is possible to perform plasma cleaning by a simple configuration and at a suitable timing.

Figure 5:
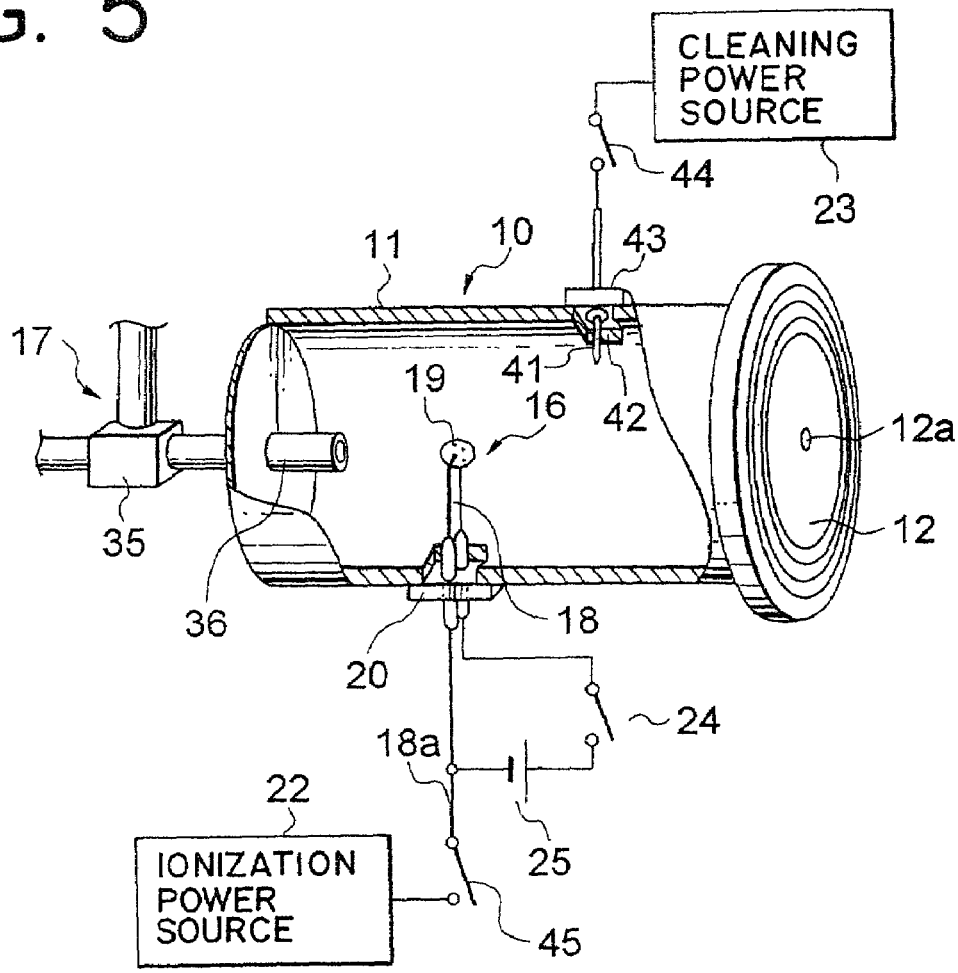
FIG. 5 is a perspective view of a second embodiment of an ionization apparatus according to the present invention partially cut away to show the principal structure inside.
Figure 6:
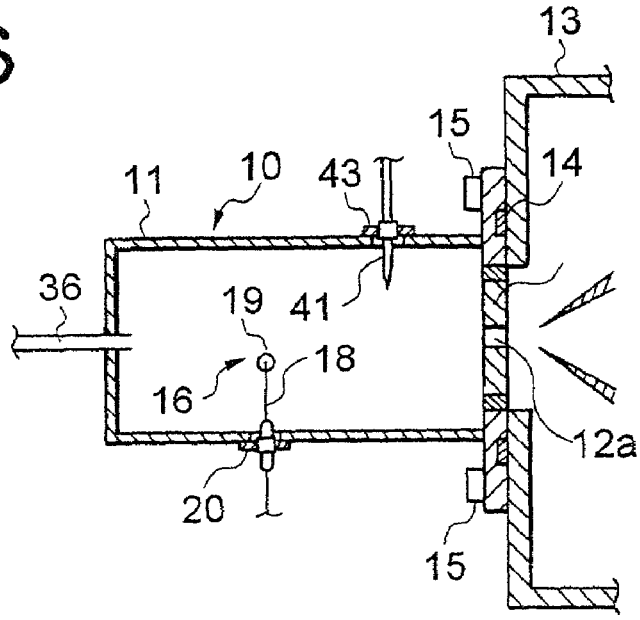
FIG. 6 is a longitudinal sectional view of principal parts of the ion apparatus shown in FIG. 1.

Next, a second embodiment of the present invention will be explained with reference to FIG. 5 and FIG. 6. FIG. 5 is a perspective view of an ionization apparatus partially cut away to show the principle structure inside, while FIG. 6 is a longitudinal sectional view of the same. In FIG. 5 and FIG. 6, elements substantially the same as elements explained in the first embodiment are assigned the same reference numerals and detailed explanations thereof are omitted. Further, in FIG. 5 and FIG. 6, a detailed illustration of the gas introduction mechanism 17 explained in the first embodiment is omitted, but the mechanism has the same configuration.

In the second embodiment, compared with the first embodiment, the ion emission mechanism 16 is not used as the electrode in the plasma cleaning process. An electrode 41 is separately provided in the cylindrical part of the hollow vessel 11. The electrode 41 is a straight shaped needle member. The front end is preferably sharp like a needle. The electrode 41 is attached through an insulator 43 at an aperture 42 formed at the cylindrical part of the hollow vessel 11. The above-mentioned cleaning power source 23 is connected to the outside end of the electrode 41 through the switch 44. As much as possible, it is preferable that there be no projecting portions in the hollow vessel 11, so the dimensions of the inwardly projecting part of the electrode 41 are suitably determined in consideration of this point. Further, the terminal 18*a* of the lead wire 18 is connected through the switch 45 to the ionization power source 22. The ON/OFF operations of the switches 44 and 45 are controlled at suitable timings in accordance with the ionization process or cleaning process by a control device. The rest of the configuration is the same as the configuration explained in the first embodiment.

Further, in the second embodiment, the potential of the hollow vessel 11, the potential of the ion emitter 19, and the potentials of the other components inside may be freely set by a not shown power source.

In the configuration of this embodiment, the ion emitter 16 is used only for the ion attachment ionization process. Only the above-mentioned ionization power source 22 is connected to the outside end 18*a* of the lead wire 18 of the ion emission mechanism 16. At the time of the ionization process, the electrode 41 has no function at all. On the other hand, when causing discharge at the ionization zone to produce plasma for a cleaning action, the needle shaped electrode 41 is supplied with predetermined power from the above-mentioned cleaning power source 23.

In the ionization apparatus according to the second embodiment, as explained above, the target gas and third-body gas are simultaneously introduced from the gas introduction pipe member 36 under the pressure condition in the hollow vessel 11, metal ions are emitted from the ion emitter 19, and ionization occurs in the ionization zone. Further, to remove the by-products, only third-body gas is introduced from the introduction pipe member 36 at a suitable timing under the same pressure condition and the above predetermined voltage is supplied to the electrode 41 to generate plasma for cleaning the apparatus.

As explained above, if the ionization process is performed continuously or intermittently for more than a certain time, by-products deposit on the components in the ionization apparatus, so after a certain time, the introduction of the target gas is stopped and only the third-body gas is introduced as it is as a discharge gas. In that state, a predetermined power is supplied to the electrode 41 to cause the generation of plasma in the ionization zone. As the potential at this time, when removing deposits from the ion emitter 19, the ion emitter 19 is made the lowest potential among the components facing the ionization zone by a not shown power source, the ions produced by the plasma are pulled in, and the ions are made to impact with its surface. Further, when removing deposits from the inside wall of the hollow vessel 11, the inside wall of the hollow vessel is made the lowest potential among the components facing the ionization zone. That is, the component having the deposits desired to be removed is made the lowest potential. Note that if a plurality of components are made the same potential and lower potentials than other components, it is possible to simultaneously remove deposits on these plurality of components.

Note that in the second embodiment, the position of attachment of the electrode 41 is preferably the illustrated position, but the electrode can be set to any position in accordance with the objective.

Figure 7:
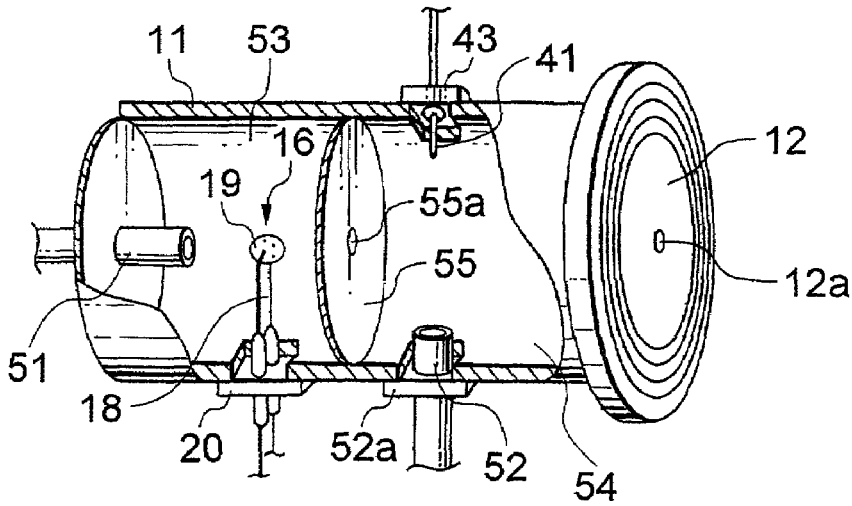
FIG. 7 is a perspective view of a third embodiment of an ionization apparatus according to the present invention partially cut away to show the principal structure inside.

Next, a third embodiment of the present invention will be explained with reference to FIG. 7. In FIG. 7, elements substantially the same as elements explained in the first and second embodiments are assigned the same reference numerals and explanations thereof are omitted. The third embodiment is a modification of the configuration of the second embodiment.

The third embodiment is an ionization apparatus having a structure for preventing contact between the ion emitter 19 and the target gas and enabling stable, sufficient amount of emission of metal ions from the ion emitter 19 over a long period. Therefore, in the hollow vessel 11, the target gas introduction mechanism and the third-body gas introduction mechanism are provided independently. In FIG. 7, 51 designates a third-body gas introduction pipe, while 52 designates a target gas introduction pipe. The target gas introduction pipe 52 is attached through an insulator 52*a*. The target gas introduction mechanism and the third-body gas introduction mechanism are not illustrated, but conventional well known mechanisms are used. Further, the metal ion generation zone 53 arranged in the ion emission mechanism 16 and the ionization zone 54 where the target gas is introduced to are separated by the screen 55 leaving only the aperture 55*a* through which the metal ions pass. The ionization zone 54 is provided with the electrode 41. The rest of the configuration is the same as the configuration shown in FIG. 5.

In the ionization apparatus according to this embodiment, when removing deposits on the inside components, power is supplied to the electrode 41, the screen 12, screen 55, and wall of the hollow vessel 11 are made the ground potential, and the electrode 41 is made a positive potential. Due to this, plasma is generated in the ionization zone 54 and it is possible to remove deposits on the components facing the ionization zone 54. In this embodiment, since the metal ion generation zone 53 and the ionization zone 54 are separated, it is possible to prevent deposits on the surface of the ion emitter 19.

Note that the ionization apparatuses explained with reference to FIG. 5 to FIG. 7 were provided with rod-shaped electrodes 41 as the electrode for plasma generation, but it is also possible to apply power or voltage separately to part or all of the inside wall of the hollow vessel 11, the ion emission mechanism 16, and the screens 12 and 55 and other components facing the ionization zone 54 and to cause the generation of plasma by the components given the supplied power and the respective potentials.

Figure 8:
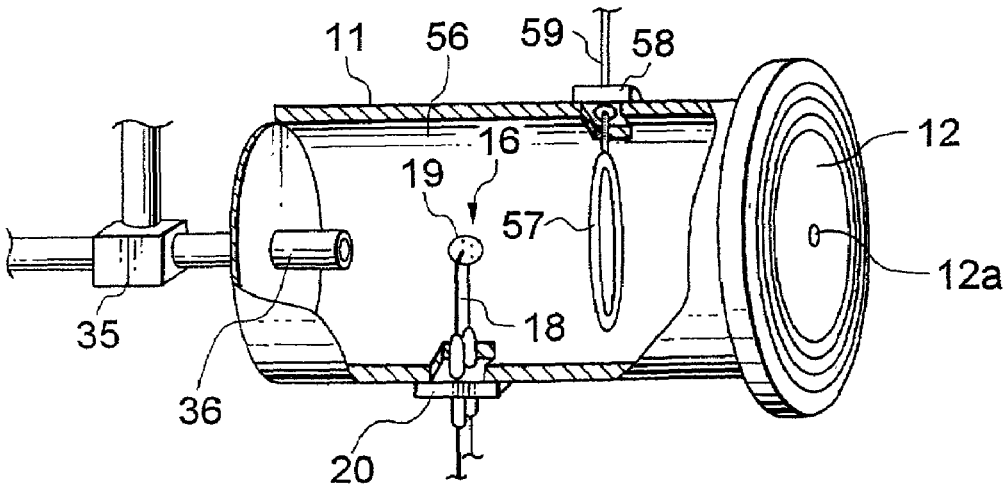
FIG. 8 is a perspective view of a fourth embodiment of an ionization apparatus according to the present invention partially cut away to show the principal structure inside.

Next, a fourth embodiment of the present invention will be explained with reference to FIG. 8. This embodiment is an example of application of the present invention to an ionization apparatus providing an ion focusing electrode 57 in the ionization chamber 56. Except for the point of not using the above electrode 41, 10 is the same in configuration as that shown in FIG. 5. In FIG. 8, elements substantially the same as elements explained in FIG. 5 are assigned the same reference numerals.

As shown in FIG. 8, the ionization apparatus is provided in the zone with a ring-shaped ion focusing electrode 57 between the ion emission mechanism 16 and aperture 12*a*. The ion focusing electrode 57 is attached in the hollow vessel 11 through the insulator 58 and is electrically connected to a power source outside of the ionization apparatus, not shown, through an electroconductive member 59 insulated from the hollow vessel 11. This power source includes the function of the above-mentioned cleaning use power source. The ion focusing electrode 57 is arranged to be coaxial with the center axis of the hollow vessel 11. Voltage is supplied so that the ion focusing electrode 57 on that axis becomes slightly higher in potential than the potential of the position corresponding to its position of arrangement. The ion focusing electrode 57 focuses the metal ions and ions of the sample gas, being transported from the zone where the ion emission mechanism 16 is arranged to the screen 12 side, at the center axis of the hollow vessel 11.

In the ionization apparatus according to this embodiment, when removing deposits on inside components, the zone inside the apparatus is maintained at a predetermined pressure and power is supplied from the cleaning use power source to the ion focusing electrode 57. If the ion emitter 19 or the inside wall of the hollow vessel 11 is made lower in potential than other components at this time, it is possible to remove deposits on the component selected for the lower potential using the energy of the ions produced in the ionization zone 56.

Further, a fifth embodiment of an ionization apparatus according to the present invention will be explained with reference to FIG. 9. This ionization apparatus has an ion trap function for trapping and storing metal ions in a predetermined space. By introducing the target gas into that space, it can produce ions of the sample gas and separate only ions of a mass heavier than the metal ions and emit them outside of the apparatus.

Figure 9:
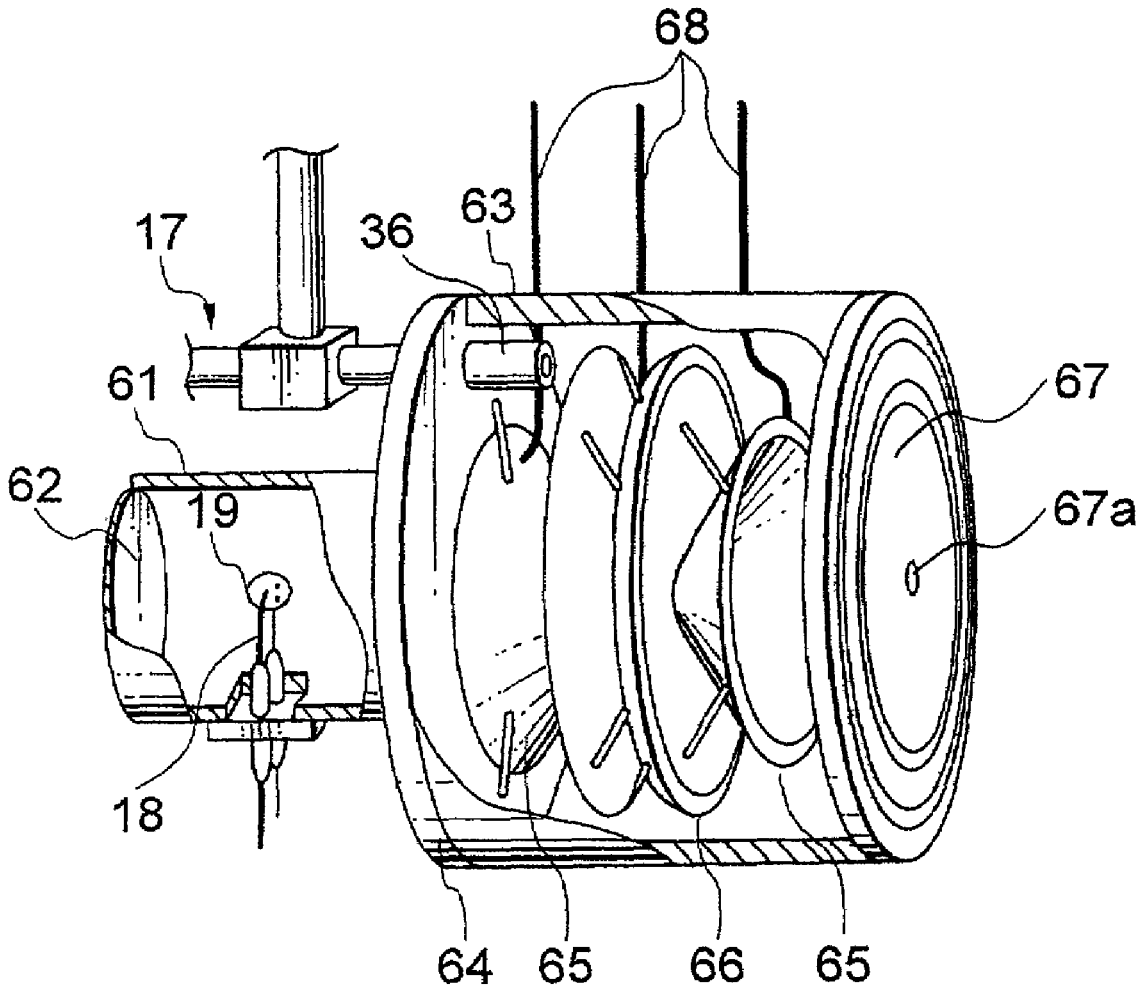
FIG. 9 is a perspective view of a fifth embodiment of an ionization apparatus according to the present invention partially cut away to show the principal structure inside.

As shown in FIG. 9, this ionization apparatus has an ion generation zone 62 inside of a hollow vessel 61 and a ionization zone inside a vessel 63 separated by a screen 64 having an aperture of an extent enabling transport of metal ions. The hollow vessel 61 is provided with the lead wire 18 and ion emitter 19 based on a configuration the same as that shown in for example FIG. 5. Further, the ionization zone is comprised of the gas introduction mechanism 17 and introduction pipe member 36 for introducing the target gas and third-body gas, two end gap electrodes 65 for trapping and storing metal ions in a predetermined space, and a ring-shaped electrode 66 arranged between them. The end gap electrodes 65 and ring-shaped electrode 66 are supplied with a superposed voltage of a DC voltage and AC voltage and form inside them a three-dimensional hyperbolic electromagnetic field. As is well known, the movement of the ions is controlled by the relationship of the DC and AC voltages of the superposed voltage. The metal ions are trapped in a predetermined space inside. Only ions having mass more than that of a specified mass number are emitted from the aperture 67*a* provided at the screen 67 to the outside of the apparatus. In FIG. 9, 68 shows electroconductive members for supplying DC or AC voltage to the end gap electrodes 65 and ring-shaped electrode.

When removing deposits on the components in the above ionization apparatus, one of the two end gap electrodes 65 or the ring-shaped electrode 66 is used as the electrode for plasma generation. Regarding the potential of the components, in the same way as in the ionization apparatus explained in the above embodiments, the component on which the by-products desired to be removed are deposited is made the lowest potential.

In the ionization apparatus according to the present invention, it is also possible to provide the gas introduction mechanism and the evacuation mechanism for maintaining the ionization zone at a predetermined pressure separately for the plasma generation. In particular, directly providing an evacuation mechanism in the ionization apparatus prevents the discharge gas and the gaseous molecules produced by the reaction of for example the by-products and discharge gas from flowing into the mass spectrometry apparatus and enables prevention of the parts inside the mass spectrometry apparatus from secondary contamination. Further, when it is not possible to provide an electrode for plasma generation directly in the ionization zone due to the configuration of the apparatus, it is possible to provide a zone adjoining the ionization zone and use that zone as the plasma generation zone.

Figure 10:
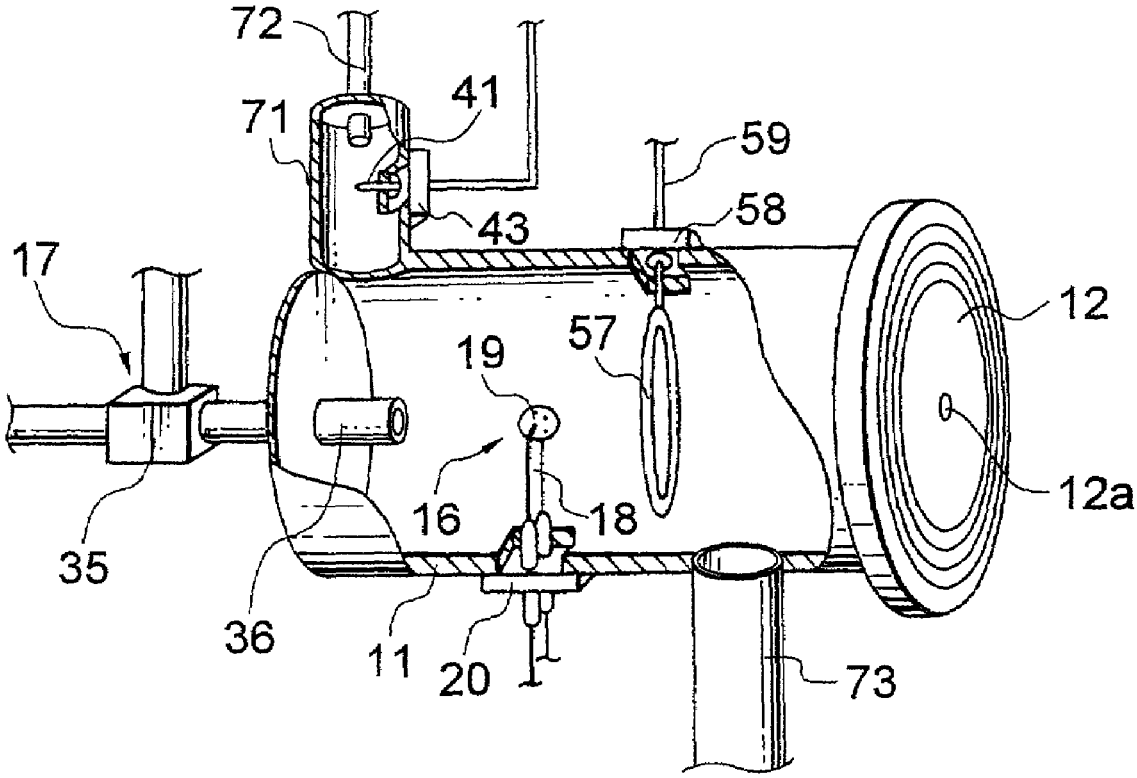
FIG. 10 is a perspective view of a sixth embodiment of an ionization apparatus according to the present invention partially cut away to show the principal structure inside.

FIG. 10 shows a sixth embodiment of the ionization apparatus according to the present invention in which a discharge gas introduction mechanism and evacuation mechanism are separately provided and further an ionization zone and plasma generation zone are separately provided. In FIG. 10, elements substantially the same as the elements explained in the above embodiments are assigned the same reference numerals. The configuration of this ionization apparatus consists of a combination of the configurations shown in FIG. 5 and FIG. 8 plus the separate provision of the plasma generation zone structure.

As shown in FIG. 10, the side surface of the bottom of the closed-end hollow vessel 11 is provided with a plasma generation chamber 71 comprised of a cylindrically shaped vessel smaller than the hollow vessel 11. The ionization zone inside the hollow vessel 11 is communicated with the plasma generation zone inside the plasma generation chamber 71. At the bottom of the plasma generation chamber 71 is provided a discharge gas introduction mechanism 72 for introducing discharge gas. At the wall of the hollow vessel 11 at the screen 12 side is provided an evacuation port 73 connected to a not shown vacuum pump. Further, at the cylindrical part of the plasma generation chamber 71 is provided a rod-shaped electrode 41 insulated from the plasma generation chamber 71. This electrode 41 is configured to be electrically connected to a power source outside of the ionization apparatus. Further, an ion focusing electrode 57 is provided between the ion emission mechanism 16 and the screen 12.

When removing by-products deposited on components in this ionization apparatus, discharge gas is introduced from the discharge gas introduction mechanism 72 and the plasma generation zone and the ionization zone are evaluated by the evacuation port 73 to maintain the inside zone of the ionization apparatus at a predetermined pressure. In this state, power is supplied to the electrode 41 and first plasma is caused to be generated in the plasma generation chamber 71. At this time, a voltage giving a potential higher than that of the first plasma is supplied to the ion focusing electrode 51 arranged in the ionization zone. The electrons in the first plasma are transported in the ionization zone by the electric field formed between the plasma generation zone and the ion focusing electrode 57. That is, the ion focusing electrode 57 functions as a pull-in electrode for pulling in the electrons in the first plasma to the ionization zone. In the ionization zone, the electrons impact with the discharge gas to cause a large amount of ionization and generate second plasma in the ionization zone. The by-products deposited on the components in the ionization zone are removed by the second plasma. In this way, the cleaning process is performed at a suitable timing.

The ionization apparatuses explained in the above embodiments generate plasma using capacitive discharge where power supplied to a plasma generation electrode provided in a zone maintained at a predetermined pressure is directly connected with an electrode in the plasma. Instead of this, however, it is also possible to use inductive discharge or discharge by electromagnetic wave heating etc. Further, it is possible to suitably select whether the plasma is generated by DC discharge or RF discharge.

Figure 11:
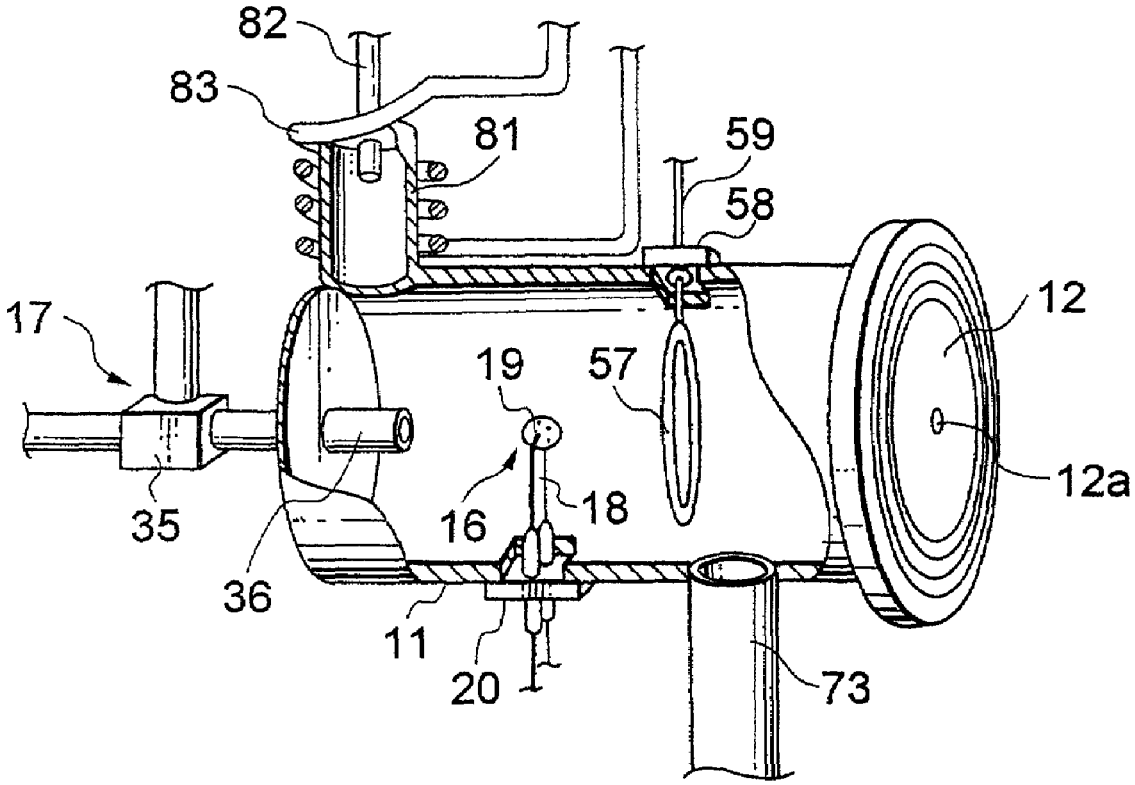
FIG. 11 is a perspective view of a seventh embodiment of an ionization apparatus according to the present invention partially cut away to show the principal structure inside.
Figure 12:
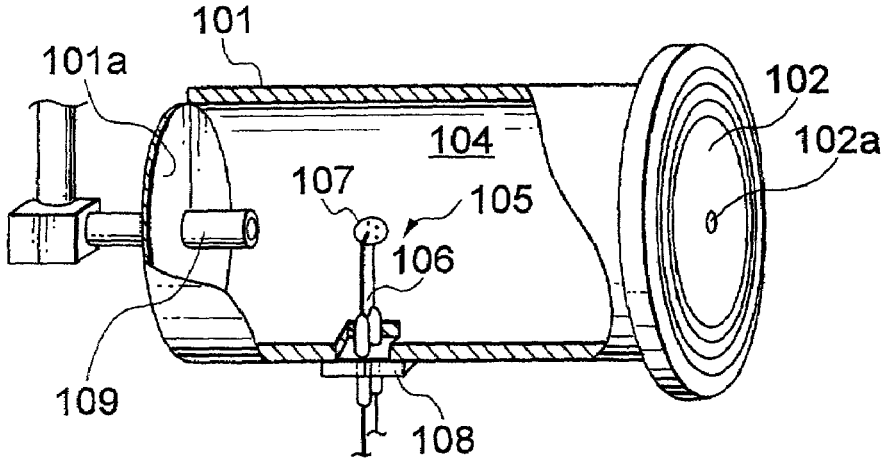
FIG. 12 PRIOR ART
FIG. 12 is a perspective view of a conventional ionization apparatus partially cut away to show the principal structure inside.
Figure 13:
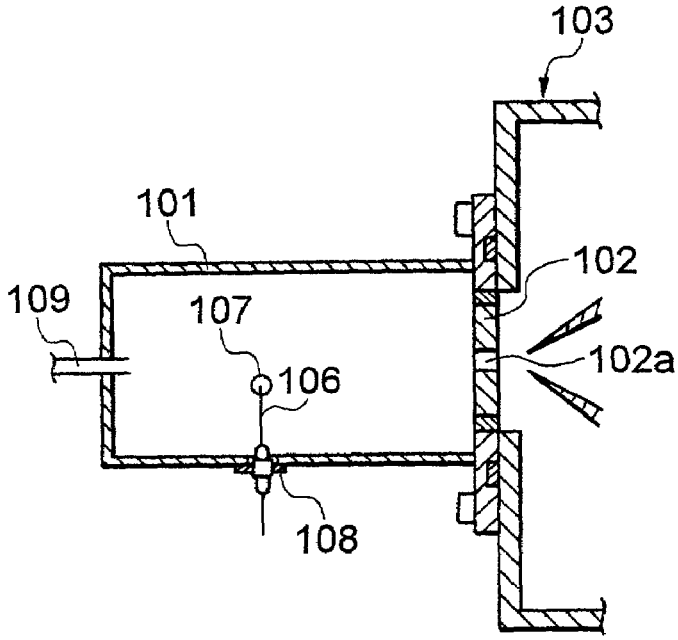
FIG. 13 PRIOR ART
FIG. 13 is a longitudinal sectional view of principal parts of the ion apparatus shown in FIG. 12.

Next, a seventh embodiment of an ionization apparatus according to the present invention will be explained based on FIG. 11. The ionization apparatus according to this embodiment causes the generation of first plasma in another zone adjoining the ionization zone and is provided with a pull-in electrode for pulling in the first plasma. The plasma is caused by inductive discharge. Further, the discharge gas introduction mechanism and evacuation mechanism are separately provided. In FIG. 11, elements substantially the same as elements explained in the above embodiments are assigned the same reference numerals.

In FIG. 11, a plasma generation chamber 81 comprised of vessel smaller than the hollow vessel 11 and having a cylindrical portion comprised of an insulator (dielectric) is provided at the side surface of the bottom of the closed-end hollow vessel 11. The ionization zone inside the hollow vessel 11 is communicated with the plasma generation zone inside the plasma generation chamber 81. A discharge gas introduction mechanism 82 for introducing discharge gas is provided at the bottom of the plasma generation chamber 81. Further, a spiral-shaped electroconductive member 83 is provided at the outside of the cylindrical part of the partition forming the plasma generation chamber 81. An evacuation port 73 connected with a not shown vacuum pump is provided at the screen 12 side wall of the hollow vessel 11. The rest of the basic configuration is the same as the configuration explained in the embodiment shown in FIG. 10.

In the above ionization apparatus, when removing deposits on the inside components, discharge gas is introduced from the discharge gas introduction mechanism 82 and the evacuation port 73 and evacuation mechanism are used to evacuate the plasma generation zone and ionization zone to maintain the zone inside the ionization apparatus at a predetermined pressure. In this state, RF power is supplied from a not shown RF power source to the spiral-shaped electroconductive member 83 and first plasma electrically coupled with the spiral-shaped electroconductive member via the dielectric wall of the cylindrical part of the plasma generation chamber 81 is generated in the plasma generation zone. The ion focusing electrode 57 is supplied with a voltage to give a potential higher than the first plasma and becomes a pull-in electrode pulling in the electrons in the first plasma to the ionization zone. Due to this, the electrons in the first plasma are transported inside the ionization zone and impact with the discharge gas to cause a large amount of ionization and thereby generate second plasma in the ionization zone. The deposits on the components inside the ionization chamber are removed by this second plasma thereby cleaning them.

In the above ionization apparatuses, preferably the process of making the metal ions attach to the target gas to generate ions of the sample gas and emitting the ions of the sample gas to the mass spectrometry apparatus and the process of causing the generation of plasma in the ionization zone to remove the by-products deposited on the inside components are performed consecutively. Due to this, it is possible to restore the ionization performance before the performance of the ionization apparatus drops and possible to prevent a memory effect relating to preceding or succeeding measurement by mass spectrometry qualitatively or quantitatively different and thereby perform accurate measurement by mass spectrometry.

Further, if employing oxygen as the discharge gas, it is possible to simultaneously oxidize the surface of the ion emitter at the time of removing the deposits on the components by plasma and possible to perform measurement by mass spectrometry immediately after the removal process.

The present disclosure relates to subject matter contained in Japanese Patent Application No. 2001-96832, filed on Mar. 29, 2001, the disclosure of which is expressly incorporated herein by reference in its entirety.

What is claimed is:

1. An ionization apparatus, comprising:

means for generating metal ions by heating an ion emitter connected to a lead wire, the lead wire providing a current for heating the ion emitter;

means for causing metal ions emitted from the ion emitter to attach to a target gas so as to produce ions of a sample gas, a mechanism for emitting the ions of the sample gas to a mass spectrometer having a zone in which one or both of an electric field and magnetic field are formed, and an electrode for causing generation of cleaning plasma provided in an ionization zone for generating the ions of the sample gas, wherein said plasma removes deposits on components facing said ionization zone.

2. An ionization apparatus as set forth in claim 1, wherein any of said components arranged inside said ionization zone is used as said electrode.

3. An ionization apparatus as set forth in claim 2, wherein said ion emitter is used as said electrode.

4. An ionization apparatus as set forth in claim 2, wherein an ion focusing electrode used in an ionization process is used as said electrode.

5. An ionization apparatus as set forth in claim 1, further providing an electrode especially for discharge in said ionization zone.

6. An ionization apparatus as set forth in claim 1, wherein when causing generation of plasma, a third-body gas used in an ionization process is used as a discharge gas and substantially the same pressure condition as the pressure condition at said ionization process is used.

7. An ionization apparatus, comprising:

means for generating metal ions by heating an ion emitter connected to a lead wire, the lead wire providing a current for heating the ion emitter;

means for causing metal ions emitted from the ion emitter to attach to a target gas so as to produce ions of a sample gas, a mechanism for emitting the ions of the sample gas to a mass spectrometer having a zone in which one or both of an electric field and magnetic field are formed, a hollow vessel formed to have an ionization zone in which ions of the sample gas are produced, and having a wall at the ionization zone side made by an electroconductive member, an ion emission mechanism for emitting said metal ions, a discharge gas introduction mechanism for introducing a discharge gas into said ionization zone, and an evacuation mechanism for discharging said discharge gas being introduced into said ionization zone outside of said hollow vessel, wherein the discharge gas being introduced into said ionization zone by said discharge gas introduction mechanism while said ionization zone is evacuated by said evacuation mechanism so as to maintain it at a predetermined pressure and one of said ion emission mechanism and said hollow vessel is used as a cathode and the other is used as an anode to cause generation of plasma in said ionization zone so as to remove a deposit on a component used as the cathode facing said ionization zone.

8. An ionization apparatus as set forth in claim 7, wherein when removing the deposit on said ion emission mechanism facing said ionization zone, said ion emission mechanism is used as the cathode, while when removing the deposit on the inside walls of said hollow vessel facing said ionization zone, said inside wall of said hollow vessel is used as the cathode.

9. An ionization apparatus as set forth in claim 8, wherein when said target gas is gaseous state organic matter, after the ionization of said target gas, oxygen is introduced into the ionization zone and plasma is caused to be generated in said ionization zone while maintaining said predetermined pressure.

10. An ionization apparatus as set forth in claim 7, wherein the process of removing the deposit on a component facing said ionization zone by causing the generation of plasma in said ionization zone is performed consecutively after the process of causing said metal ions to attach to said target gas to generate said ions of the sample gas and emitting said ions of the sample gas to said mass spectrometer.

11. An ionization apparatus as set forth in claim 10, wherein when said target gas is a gaseous state metal compound or a compound including a semiconductor, after said target gas is ionized, a halogen-based gas is introduced into said ionization zone and the plasma is caused to be generated in said ionization zone while maintaining said predetermined pressure.

12. An ionization apparatus, comprising:

means for generating metal ions by heating an ion emitter connected to a lead wire, the lead wire providing a current for heating the ion emitter;

means for causing metal ions emitted from the ion emitter to attach to a target gas so as to produce ions of the sample gas, a mechanism for emitting the ions of said sample gas to a mass spectrometer having a zone in which one or both of an electric field and magnetic field are formed, a plasma generation chamber having a plasma generation zone communicated with said ionization zone where the ions of said sample gas are produced, and provided with a discharge gas introduction mechanism and plasma generation mechanism, a plasma pull-in electrode arranged at said ionization zone, and an evacuation mechanism for evacuating said ionization zone and plasma generation zone, wherein said ionization zone and plasma generation zone being held at a predetermined pressure, said plasma generation zone being made to generate first plasma by said plasma generation mechanism, said first plasma being pulled into said ionization zone by the plasma pull-in electrode to cause generation of second plasma, and thereby deposits on components facing said ionization zone being removed.

13. An ionization apparatus as set forth in claim 12, wherein said plasma generation mechanism uses a rod-shaped electrode.

14. An ionization apparatus as set forth in claim 12, wherein said plasma generation mechanism uses a spiral-shaped electroconductive member.

15. An ionization apparatus as set forth in claim 12, wherein said pull-in electrode serves also as an electrode contributing to transport of ions when emitting the ions of said sample gas to said mass spectrometer.

16. An ionization apparatus, comprising:

an ion emitter that emits metal ions in an ionization zone to attach to a target gas so as to produce ions of a sample gas, the ion emitter being connected to a lead wire and being heated by a voltage supplied through the lead wire to emit ions;

a device that emits the ions of the sample gas to a mass spectrometer having a zone in which one or both of an electric field and magnetic field are formed;

an electrode that generates cleaning plasma provided in the ionization zone, wherein the plasma removes deposits and components facing the ionization zone.

* * * * *